US005398574A

United States Patent [19]

Spirer

[11] Patent Number: 5,398,574

[45] Date of Patent: Mar. 21, 1995

[54] FLUID OPERATING TOOL

[75] Inventor: Steven Spirer, Haworth, N.J.

[73] Assignee: Unex Corporation, South Hackensack, N.J.

[21] Appl. No.: 996,962

[22] Filed: Dec. 23, 1992

[51] Int. Cl.[6] ..... B25B 29/02

[52] U.S. Cl. ..... 81/57.38; 81/57.39

[58] Field of Search ..... 81/57.38, 57.39, 57.14, 81/57.22, 57.24, 57.3, 57.32, 57.36; 254/29 A

[56] References Cited

U.S. PATENT DOCUMENTS

| | | | |
|---|---|---|---|
| 2,339,210 | 1/1944 | Volz | 81/DIG. 5 X |
| 3,287,999 | 11/1966 | Kreckel et al. | 254/29 A X |
| 3,877,326 | 4/1975 | Köck et al. | 81/57.38 |
| 4,246,810 | 1/1981 | Keske | 81/57.38 |
| 4,659,065 | 4/1987 | Simms | 81/57.38 X |
| 4,706,527 | 11/1987 | Junkers | 81/57.39 |
| 4,773,146 | 9/1988 | Bunyan | 81/57.38 X |

*Primary Examiner*—D. S. Meislin

*Attorney, Agent, or Firm*—Michael J. Striker

[57] ABSTRACT

A fluid-operated tool for elongating a stud which has an axis and an end extending out over a nut, the tool comprises stud pulling unit adapted to engage the end of the stud so as to pull the stud, nut turning unit adapted to engage the nut so as to turn the nut, first fluid-operated unit acting on the stud pulling unit so that the stud pulling unit pull the end of the stud to elongate the stud, second fluid-operated unit acting on the nut turning unit so that the nut turning unit turns the nut, the first fluid-operated unit and the second fluid-operated unit communicating with a fluid source so that a pressure fluid supplied by the fluid source to the first fluid-operated unit and the second fluid-operated unit elongates the stud and turns the nut.

22 Claims, 5 Drawing Sheets

FLUID OPERATING TOOL

BACKGROUND OF THE INVENTION

The present invention relates to fluid-operated tools for tightening and loosening threaded connectors, including an inner threaded part such as for example a stud and an outer threaded part such as for example a nut screwed on the stud.

Fluid-operated tools of the above mentioned general type are known in the art. In particular, tools are known in which one element pulls the stud so as to elongate it, and another element of the tool thereafter turns the nut so as to retain the achieved elongation. Therefore, the mechanisms for coordination of the application of the pulling force to the stud and of the turning force to the nut are quite complicated. It has also been found that a substantial power of the fluid drive is consumed in order to achieve a desired elongation of the stud. It is believed to be clear that it would be advisable to design a tool which has a lower power consumption.

SUMMARY OF THE INVENTION

Accordingly, it is an object of the present invention to provide a fluid operated tool for tightening and loosening threaded connectors, which avoids the disadvantages of the prior art.

More particularly it is also an object of the present invention to provide a fluid operated tool for tightening and loosening threaded connectors in which the respective coordination of the elongation of the stud and turning of the nut is performed in a simple manner.

It is also an object of the present invention to provide a fluid operated tool for tightening and loosening of threaded connectors which provides a desired elongation of a stud with a lower power consumption than existing tools.

In keeping with these objects and with others which will become apparent hereinafter, one feature of the present invention resides, briefly stated, in a fluid-operated tool for elongating a stud which has an axis and an end extending out over a nut, the tool has stud pulling means adapted to engage the end of the stud so as to pull the stud, nut turning means adapted to engage the nut so as to turn the nut, first fluid-operated means acting on the stud pulling means so that the stud pulling means pull the end of the stud to elongate the stud, second fluid-operated means acting on the nut turning means so that the nut turning means turns the nut, the first fluid-operated means and the second fluid-operated means communicating with a fluid source so that a pressure fluid supplied by the fluid source to the first fluid-operated means and the second fluid-operated means elongates the stud and turns the nut.

When the tool is designed in accordance with the present invention, the coordination between the elongation of the stud and the turning of the nut is obtained in a simple manner. The fluid pressure of the fluid source can be applied to the stud pulling means and to the nut turning means simultaneously so as to simultaneously turn the nut and elongate the stud. On the other hand the fluid pressure can be retained by controlling means so that the stud pulling means does not elongate the stud while the nut turning means turn the nut.

In accordance with another feature of the present invention, the stud pulling means includes an engaging element arranged to engage the end of the stud and having an axis, the first fluid-operated means being formed as fluid-operated cylinder-piston means including a plurality of cylinders arranged on top of one another along the axis and having cylinder chambers, and a plurality of pistons axially movable in the cylinder chambers.

When the tool is designed in accordance with these features, the pistons simultaneously apply a pulling force to the same engaging element which pulls the stud, and a higher-pulling force is generated with a predetermined power consumption from the fluid source. Vice versa, the same force which is applied for pulling the stud is produced with a lower power consumption of the fluid source.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
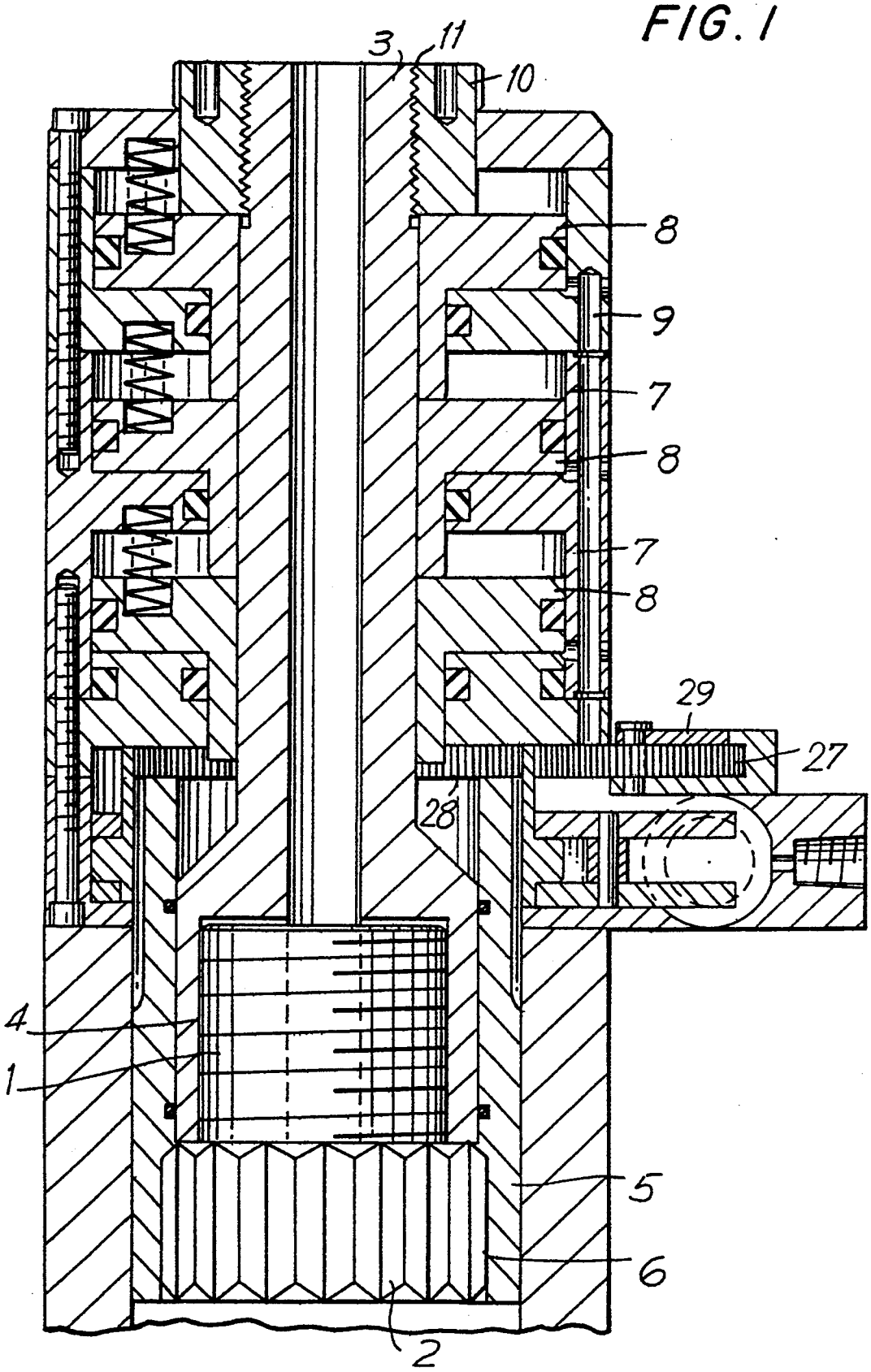
FIG. 1 is a view showing a section of a fluid-operated tool for elongating a stud and turning a nut, in accordance with the present invention.

The fluid operated tool in accordance with the present invention is used for tightening and loosening a threaded connector which, for example, includes a stud identified with reference numeral 1 and a nut which is screwed on the stud and identified with reference numeral 2. A first engaging element 3 engages the stud 1 via interengaging threads 4 and is displaceable in an axial direction of the threaded connector so as to pull the stud and elongate the latter. A second engaging element 5 is engageable with the nut 2 via interengaging hexagonal opening in the element 5 and hexagonal outer surface of the nut 2 and is turnable about the axis of the threaded connector so as to turn the nut.

Means is provided for displacing the first engaging element 3 in the axial direction of the threaded connector. This means includes a plurality of cylinders 7 which form working chambers and a plurality of pistons 8 each displaceable in a respective one of said working chambers. A passage 9 communicates with a fluid source and has a plurality of outlet openings, each opening into a respective one of the working chambers. The pistons 8 abut against one another and the upper piston 8 abuts against a cap 10 which is connected with the engaging element 3 through interengaging threads 11. When a lower portion of the engaging element 3 is screwed on the stud 4 and a working fluid is supplied from the fluid source into the chambers 7, the pistons are displaced in the chambers in abutment against one another and displace the engaging element 3 upwardly in the drawings so as to pull the upper end of the stud 1 upwardly and therefore to elongate the stud. Due to the provision of the plurality of pistons, with the same power of the fluid source a pulling force developed by the pistons and applied to the engaging element 3 is significantly higher than when a single chamber with a single piston is provided.

As can be seen from the drawings, the pistons 8 are circular and surround the engaging element 3. Since they have radially inner portions abutting against one another which can be formed as portions extending in the axial direction as shown in the drawings, the area between the pistons 8 and the engaging element 3 is sufficiently sealed, and no additional sealing means is needed to prevent penetration of the fluid into this area. The cylinders 7 also abut against one another, for example by their radially outer projections which extend in an axial direction. Therefore, no sealing means is needed in the radially outer region to prevent leaks of the fluid. The pistons and the cylinders are formed as easily mountable and demountable blocks, so that the cylinder-piston arrangement is formed as a modular arrangement. Depending on the desired stud elongation, the availability of space and fluid pressure, more or less cylinder-piston blocks and working chambers can be provided to obtain the desired stud elongation in a particular tool. Also, as shown in broken lines in FIG. 1, the engaging element 3 can be composed of two axial portions which are connectable with one another for example by threads.

Figure 2:
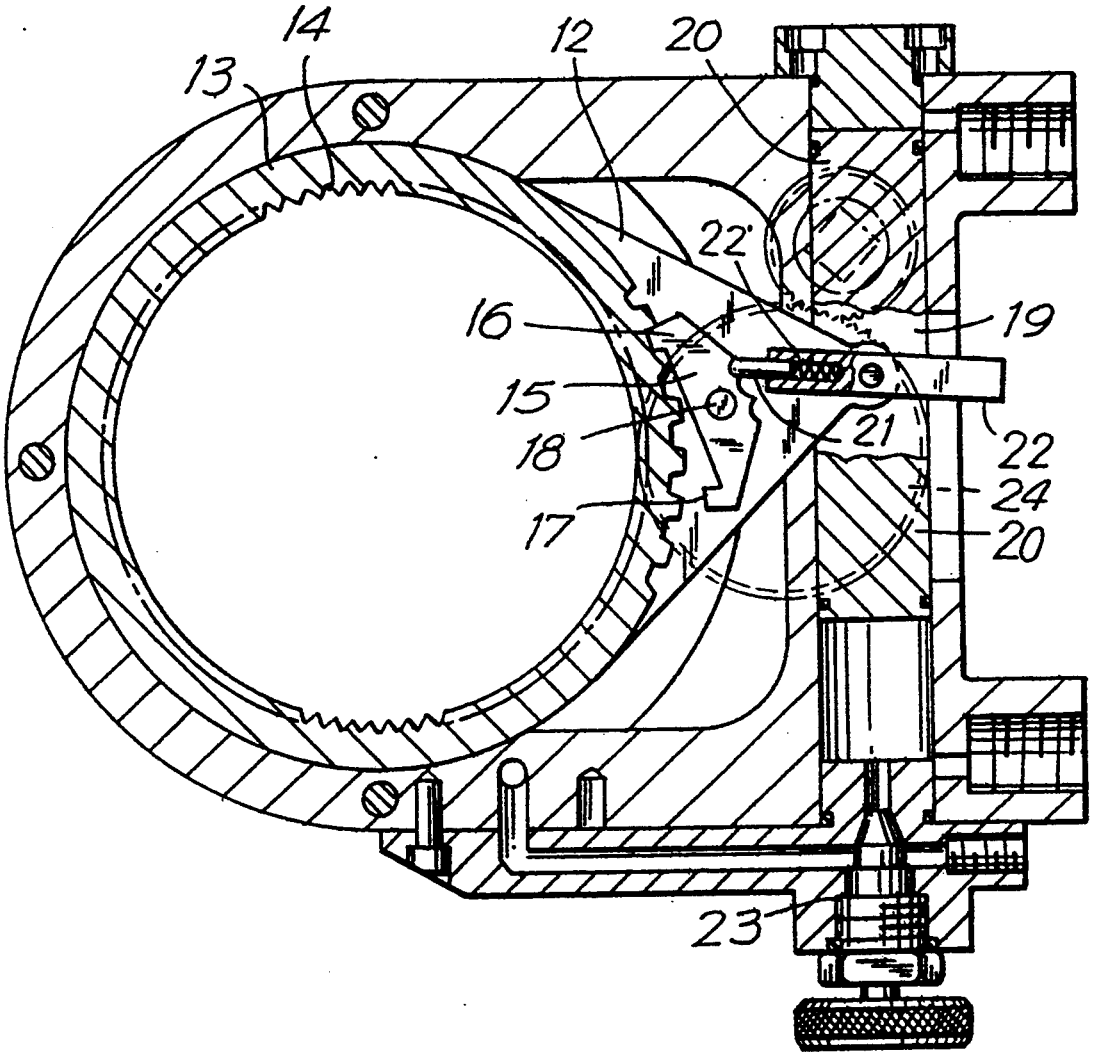
FIG. 2 is a plan view, partially sectioned, of the fluid-operated tool in accordance with the present invention.

Means for turning the nut 2 includes two drive plates 12, a ratchet 13 located between the drive plates and engaging with the engaging element 5 through a plurality of splines 14, and a pawl 15 with two engaging formations 16 and 17 engageable in the teeth of the ratchet 13. The pawl 15 is turnably mounted on the plates 12, for example, by a pin 18. The means for turning the nut further include a working chamber 19 and two pistons 20 displaceable in the working chamber 19 in opposite directions. When the working fluid is supplied in the upper part of the chamber 19 it displaces the upper piston 20 downwardly in FIG. 2 and the piston turns the drive plates in one direction. If the fluid is supplied to the lower portion of the working chamber 19 the lower piston 20 is displaced upwardly in FIG. 2 and turns the drive plates in the opposite direction. When the driving plates 12 are turned, the pawl 15 is also turned, a respective formation 16 or 17 of the pawl 15 engages in the teeth of the ratchet 13 and turns it in the respective direction, and as a result the engaging element 5 is turned and turns the nut 2. Depending on whether a tightening or a loosening of the nut is required, the direction of turning of the drive plates 12 and thereby of the engaging element 5 is selected. In order to switch the directions of turning, a switching element is provided. It includes a spring biased pin 21 arranged in a handle 22 which accommodates a spring 22'. In order to switch the direction of turning, an operator turns the handle 22 in clockwise or counterclockwise direction so that the pin 21 engages in a small recess of the pawl 15 at one side of the axis 18 or engages another small recess of the pawl 15 at the opposite side of the axis 18. Depending on these engagements, either the engaging formation 16 or the engaging formation 17 engage in the teeth of the ratchet 13. Upon supplying the fluid to the respective upper or lower piston 20, the drive plates 12 and thereby the ratchet 13 can be turned in one direction or in another opposite direction, so as to turn the engaging element 5 in a respective direction and as a result to turn the nut 2 in the respective direction.

The pawl 15, in addition to the above mentioned small recesses on the opposite sides of the axis 18 also has a central recess or a so-called neutral recess in which the pin 21 can engage as well.

The tool is further provided with a valve which is identified as a whole with reference numeral 23. The valve 23 actuated by an operator can establish communication through the chamber 19 to the passage 9, or interrupt such communication.

The fluid operated tool in accordance with the present invention operates in the following manner:

First the handle 22 is turned to a neutral position, or in other words a position in which the pin 21 engages in the central recess on the rear side of the pawl 15. Then a fluid is supplied for example in the upper part of the chamber 19, flows through the chamber 19 and then flows into the passage 9 when the valve 23 is open. From the passage 9 the fluid flows into the chambers 7, displaces the pistons 8 upwardly and thereby displaces the engaging element 3 through the member 10 also upwardly. As a result, the upper part of the portion of the stud 1 is pulled upwardly and the stud 1 is elongated. Then, if it is necessary to tighten the threaded connector, the handle 22 is turned so that the pin 21 engages in the respective recess of the pawl 15, the valve 23 is closed, and the fluid supplied into the chamber 19 turns the plate 12 together with the pawl 15, so that the pawl 15 turns the ratchet 13, and through the latter also turns the engaging element 5. As a result, the nut 2 is turned and tightened. It is to be understood that for loosening the nut, the handle 22 is turned in the opposite direction to engage the other small recess from the rear side of the pawl 15, so that the pawl 15 engages with another engaging formation in the ratchet 13. During turning of the plate 12 the ratchet 13 is turned in an opposite direction to thereby turn the engaging element 5 in an opposite direction, so as to loosen the nut 2.

It is to be understood that the operations for elongating the stud are performed when the valve 23 is open. When however the valve 23 is closed, fluid is not supplied into the passage 9 and into the chambers of the cylinder-piston unit for the stud elongation, but it applies the pressure only in the cylinder-piston unit for turning the nut. Thus, the stud elongation is retained while the nut is turned.

Figure 3:
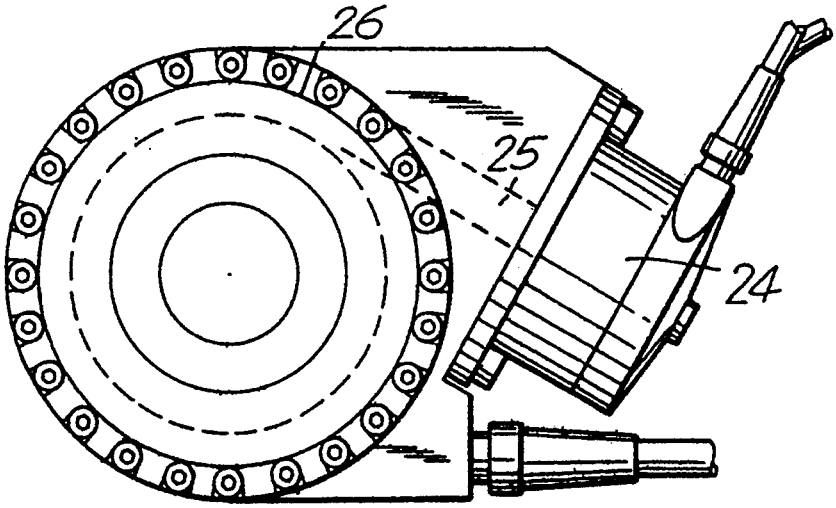
FIG. 3 is a view showing a further embodiment of a drive for the inventive fluid-operated tool.

As can be seen from the drawings, the cylinder-piston unit cooperating with the engaging element 3 and elongating the stud and the cylinder-piston units cooperating with the engaging element 5 for turning the nut are arranged perpendicular to one another. Instead of the cylinder-piston unit for turning the nut shown in the drawings, it is also possible to use a hydraulic motor 24 shown in FIG. 3. In this case the output shaft of the hydraulic motor 24 is connected with a worm rack 25 which engages with a worm gear 26. The worm gear is in turn engaged with the engaging element 5 for turning the nut 2.

The degree of turning of the nut 12 can be indicated by an indicating mechanism which includes a dial gear 27 engaging with the gear 28 which is connected with the engaging element 5 and turnable together with the latter, and a dial pointer 29 associated with the dial gear. The dial gear 27 is provided with a scale, so that during turning of the dial gear 27 resulting from the turning of the engaging element 5 and the nut 2, the dial pointer 29 points to a respective graduation of the scale, to indicate the degree of turning of the nut.

Figure 4:
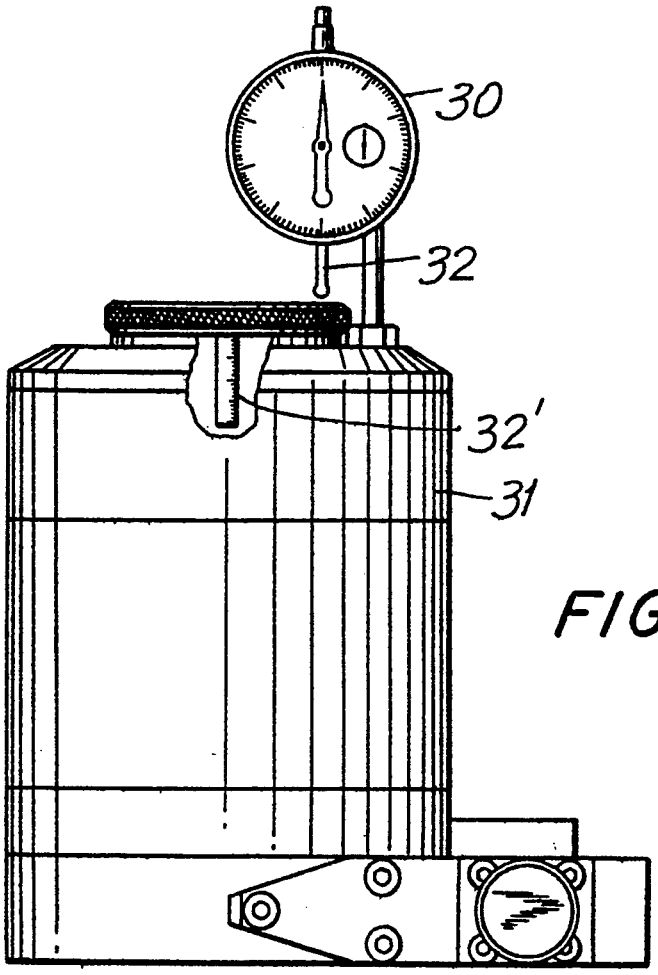
FIG. 4 is a view illustrating indicating means of the invention fluid-operated tool, in accordance with the invention.
Figure 5:
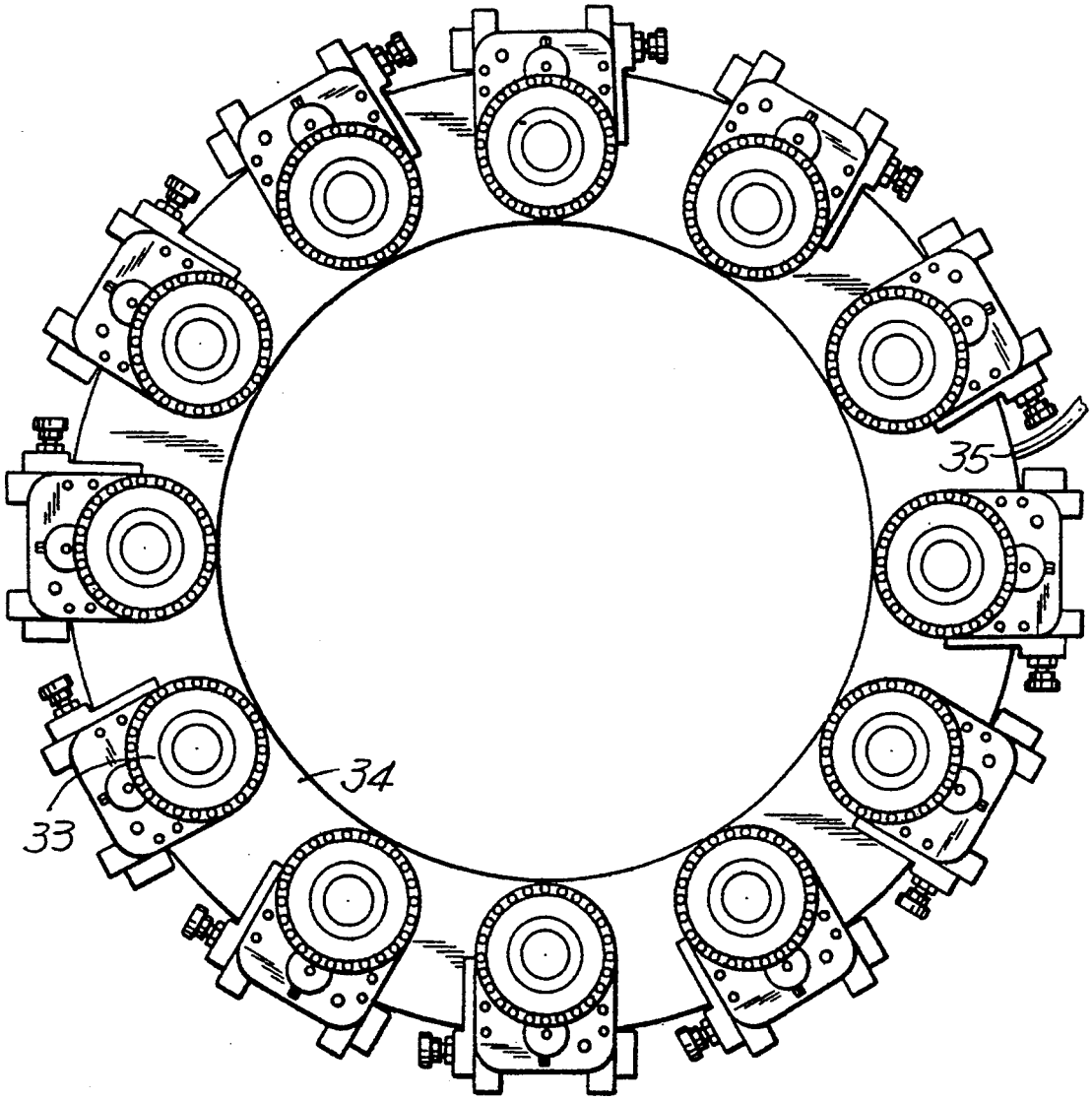
FIG. 5 is a view of a further embodiment of the inventive fluid-operated tool.

The degree of elongation of the stud can be determined in several ways. As shown in FIG. 4, a standard indicator 30 can be arranged on a housing 31 of the tool and provided with a feeler 32 which abuts against an upper surface of the cap 10. Since the cap 10 is connected with the engaging element 3 which in turn engages the end of the stud, the elongation of the stud is measured by the indicator 30 through the displacement of the engaging element 3 during the elongation process.

As can be seen in the central area of FIG. 4 with a cutout, a scale 32' can be provided so that the operator can read the elongation of the stud on the scale. It is also possible to form the engaging element 3 hollow, as shown in FIG. 1 and then to provide an outer sensor which senses the displacement of the elongated element 3 through the central hole.

Figure 6:
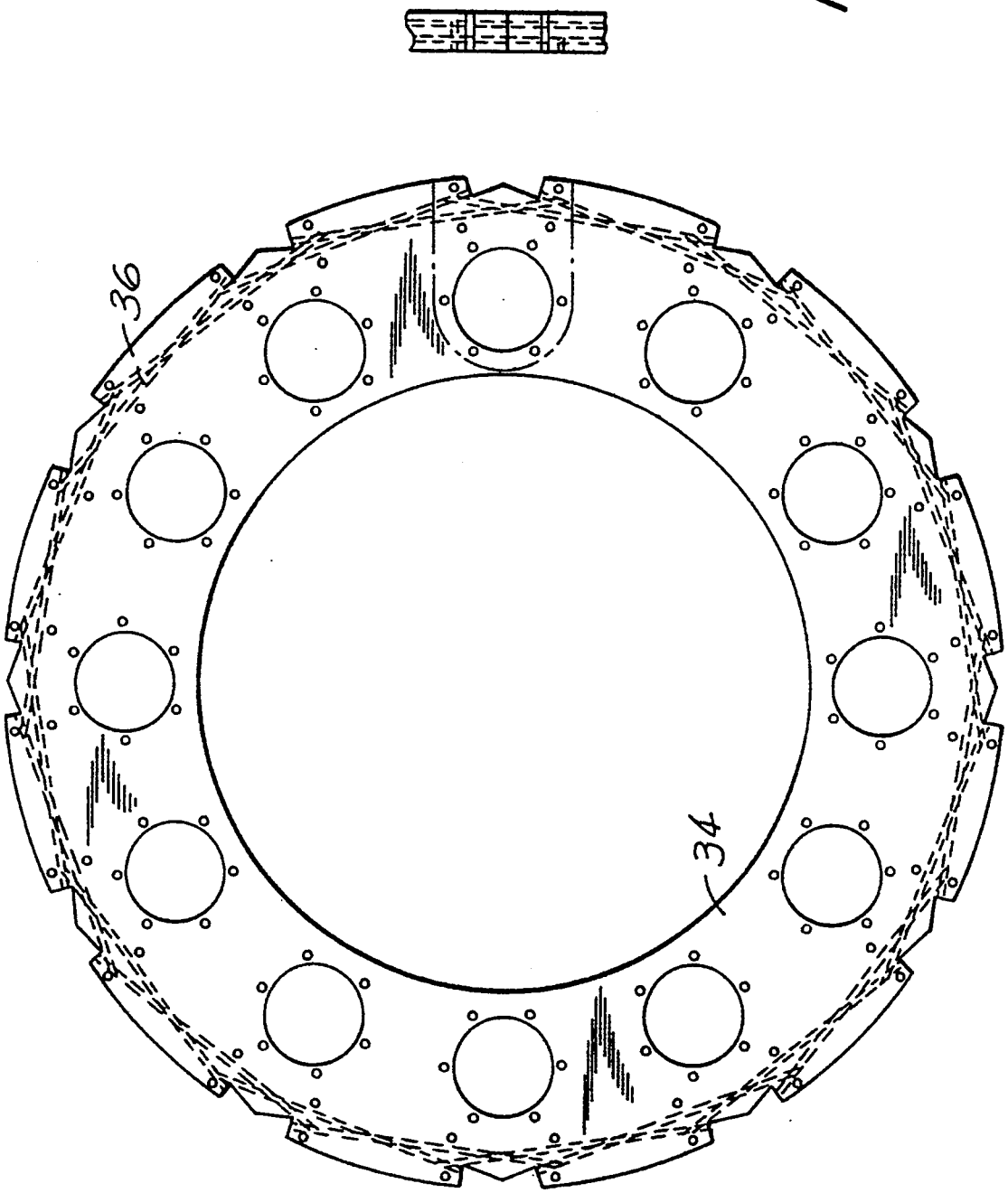
FIG. 6 substantially corresponds to the view of FIG. 6, but showing a support element for the multi-tool arrangement of FIG. 6 only without the tools.

In accordance with an advantageous embodiment of the invention, fluid-operated tool can be provided with a plurality of stud elongating means and nut turning means, or in other words with a plurality of units each having the above described stud elongating means and nut turning means. The units are identified in FIG. 6 with reference numeral 33. They are mounted on a circular support 34 and spaced from one another preferably by identical distances. Conduit means 35 connect all units 3 to a fluid source. The tools shown in FIG. 6 can be simultaneously applied on all studs/nuts which are provided on a flange and are to be elongated and tightened. Thus, simultaneously it is possible to elongate all the studs and tighten all the nuts on such a flange, and the like, by supplying fluid from the fluid source to all units 33.

As can be seen from FIG. 7 in which the tools are removed from the ring 34 the fluid can be supplied through one of the tools and then distributed over the ring 34 through passages 36 which are drilled in the ring.

When the tool is designed in accordance with the present invention, it provides for many advantages.

By turning the nut down with hydraulic means, there is no stud relaxation once the lifting pressure is taken off the tool. This eliminates the need to tension the stud over and above the required load make up for the relaxation.

The staggering modular system of the drive permits the use of regular industrial hydraulic pressure which in turn assures that there are no seal failures.

The overall radius of the tool can be kept to a minimum which permits on most applications to tension all studs simultaneously instead of every second one, or every second one on one side of the flange and every other one on the other side of the flange.

Turning the nut with hydraulic means gives the operator more torque which also permits loosening of a corroded nut after the stud is pulled up by the tensioner and the nut is unloaded.

Turning the nut with hydraulic means also allows the operator to tighten the nut prior to tensioning the stud so as to pull the flange together, then elongate the stud and keep the elongation on while turning the nut again down onto the flange.

Turning the nut with hydraulic means also eliminates faying and surface embedment of the nut onto the flange, since the nut can be turned down onto the flange so that there is no gap between the nut face and the flange face and so that the engaged bolt and nut threads are loaded up before the pulling force is taken off the tensioner.

As the tensioner sits with its housing on the flange surface, measuring by means of dial-indicators is relatively easy since the housing height relates to the flange and the difference between the engaging element height before and after tensioning shows the accomplished elongation.

Finally, another advantage is that the cylinder chambers can be staggered on top of one another without having to seal the area where they meet. Thus, the portions can be added without worrying about leakage. Sure, in this case the engagement means have to be lengthened but that is a minor expense considering that another piece can just be screwed on the top where the puller nut is screwed on since the pistons do not have to be sealed with the engaging element either.

It will be understood that each of the elements described above, or two or more together, may also find a useful application in other types of constructions differing from the types described above.

While the invention has been illustrated and described as embodied in a fluid operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fluid-operated tool for tightening and loosening a threaded connector including a stud which has an axis and an end extending out over a nut, the tool comprising stud pulling means adapted to engage the end of the stud so as to pull the stud; nut turning means adapted to engage the nut so as to turn the nut; first fluid-operated means acting on said stud pulling means so that said stud pulling means pulls said end of the stud to elongate the stud; second fluid-operated means acting on said nut turning means so that said nut turning means turns the nut, said first fluid-operated means and said second fluid-operated means communicating with a fluid source so that a pressure fluid supplied by the fluid source to said first fluid-operated means and said second fluid-operated means elongates the stud and turns the nut; and controlling means operative so that fluid first acts on said stud pulling means so that said stud pulling means first pulls said end of the stud to elongate the stud, and then it stops acting on said stud pulling means and acts on said nut turning means so that, after elongation of said stud by said stud pulling means, said nut turning means turn the nut.

2. A fluid-operated tool as defined in claim 1, wherein said stud pulling means includes an engaging element arranged to engage the end of the stud and having an axis, said first fluid-operated means being formed as fluid-operated cylinder-piston means including a plurality of cylinders arranged on top of one another along said axis and having cylinder chambers, and a plurality of pistons axially movable in said cylinder chambers.

3. A fluid-operated tool as defined in claim 2, wherein each of said cylinders with each of said pistons is formed as an individual block which is insertable in and removable from said fluid-operated cylinder-piston means, so that said fluid-operated cylinder-piston means is formed as a modular arrangement.

4. A fluid-operated tool as defined in claim 2; and further comprising means for connecting said engaging element with said fluid-operated cylinder-piston means so that a combined displacement of all said pistons in said cylinder chambers is transferred to said engaging element.

5. A fluid-operated tool as defined in claim 4, wherein said pistons of said fluid-operated cylinder-piston means abut against one another and displace in abutment against one another so that during the combined displacement of said pistons a combined force of said pistons is applied to said engaging element.

6. A fluid-operated tool as defined in claim 1, wherein said first fluid-operated means is formed as a cylinder-piston means having a piston, said stud pulling means including an engaging element adapted to engage the end of the stud, said piston of said cylinder-piston means surrounding said engaging element and acting on it so as to pull the stud.

7. A fluid-operated tool as defined in claim 2, wherein said stud pulling means includes an engaging element adapted to engage the end of the stud so as to pull the stud, said pistons of said cylinder piston means surrounding said engaging element and cooperating with one another so that the fluid is prevented by said pistons from reaching an area between said pistons and said engaging element.

8. A fluid-operated tool as defined in claim 2, wherein said cylinders of said fluid-operated cylinder-piston units have mating areas cooperating with one another so as to seal said cylinder chambers and prevent escape of the fluid.

9. A fluid-operated tool as defined in claim 1, wherein said stud pulling means includes an engaging element having an axis and adapted to engage the end of the stud, said engaging element including at least two axial portions connectable with one another.

10. A fluid-operated tool as defined in claim 9; and further comprising means for connecting said axial portions of the engaging elements with one another and including threads.

11. A fluid-operated tool as defined in claim 1, wherein said second fluid-operated means which acts on said nut turning means includes a fluid-operated cylinder-piston unit.

12. A fluid-operated tool as defined in claim 11; and further comprising a ratchet mechanism operated by said cylinder-piston unit and having engaging means for engaging said nut, so that upon actuation of said cylinder-piston unit the nut is turned by said ratchet mechanism.

13. A fluid-operated tool as defined in claim 1, wherein said first fluid-operated means acting on said stud pulling means includes a first fluid-operated cylinder-piston unit, said second fluid-operated means acting on said nut turning means and including a second fluid-operated cylinder-piston unit, said cylinder-piston units being arranged in different planes.

14. A fluid-operated tool as defined in claim 1, wherein said cylinder piston units have axes extending perpendicular to one another.

15. A fluid-operated tool as defined in claim 1, wherein said stud pulling means includes an engaging element adapted to engage the end of the stud so as to pull the stud, said first fluid-operated means including fluid-operated cylinder-piston means; and further comprising a housing accommodating said engaging element and said cylinder-piston means.

16. A fluid-operated tool as defined in claim 15, wherein said nut turning means includes a turnable nut engaging member; and further comprising means for indicating a degree of turning of the nut and cooperating with said nut engaging member to determine the degree of its turning and thereby the degree of turning of the nut.

17. A fluid-operated tool as defined in claim 1; and further comprising means for indicating a degree of elongation of the stud.

18. A fluid-operated tool as defined in claim 17, wherein said stud pulling means includes an engaging element adapted to engage the end of the stud and to displace so as to pull the stud, said means for indicating the degree of elongation of the stud cooperating with said engaging element so as to indicate its displacement and therefore to indicate the degree of elongation of the stud.

19. A fluid-operated tool as defined in claim 17, wherein said stud pulling means includes an engaging element adapted to engage the end of the stud, said engaging element having a hole through which the end of the stud is exposed so that a measuring tool can detect the elongation of the stud through said hole in said engaging element.

20. A fluid-operated tool as defined in claim 1, wherein said second fluid-operated means acting on said nut turning means is located upstream of said first fluid-operated means acting on said stud pulling means as considered in direction of flow of the fluid.

21. A fluid-operated tool as defined in claim 1, wherein said controlling means include a first control element operative for first preventing action of said second fluid-operated means on said nut turning means when said first fluid-operated means act on said stud pulling means to elongate the stud, and a second control element which after the elongation of the stud interrupts a flow of fluid to said first fluid-operated means while said first control element at this time is switched to permit the action of said second fluid-operated means on said nut turning means.

22. A fluid-operated tool as defined in claim 21, wherein said second fluid-operated means acting on said nut turning means is located upstream of said first fluid operated means acting on said stud pulling means as considered in direction of flow of the fluid, said nut turning means includes a ratchet engageable with the nut and a pawl acted upon by said second fluid-operated means and engageable with the ratchet so as to turn said ratchet and thereby to turn the nut, said first control element being formed as a pin operative to first disengage said pawl from said ratchet, said second control element being formed as a valve located between said second fluid operated means and said first fluid-operated means as considered in the direction of flow of the fluid and operative for interrupting a communication between said second fluid-operated means and said first fluid-operated means after the elongation of the stud by said first fluid-operated means, while at this time said pin is switched to provide an engagement of said pawl with said ratchet.

* * * * *